US009399548B2

(12) United States Patent
Lipinski

(10) Patent No.: US 9,399,548 B2
(45) Date of Patent: Jul. 26, 2016

(54) FLOATING INSULATION FOR A PRODUCTION TANK

(71) Applicant: Trinity High-Tech Products Ltd., St. Paul (CA)

(72) Inventor: John Lipinski, St. Paul (CA)

(73) Assignee: Trinity High-Tech Products Ltd., St. Paul (CA)

( * ) Notice: Subject to any disclaimer, the term of this patent is extended or adjusted under 35 U.S.C. 154(b) by 212 days.

(21) Appl. No.: 13/839,980

(22) Filed: Mar. 15, 2013

(65) Prior Publication Data

US 2014/0144918 A1 May 29, 2014

(30) Foreign Application Priority Data

Nov. 27, 2012 (CA) ..... 2797761

(51) Int. Cl.
*B65D 90/06* (2006.01)
*B65D 88/74* (2006.01)
*B65D 88/36* (2006.01)

(52) U.S. Cl.
CPC ..... *B65D 90/06* (2013.01); *B65D 88/36* (2013.01); *B65D 88/74* (2013.01); *Y10T 29/49826* (2015.01)

(58) Field of Classification Search
CPC ..... B65D 88/74; B65D 90/38; B65D 90/42; B65D 90/44; B65D 90/66
USPC ..... 220/592.2, 592.25, 592.26, 216, 219
See application file for complete search history.

(56) References Cited

U.S. PATENT DOCUMENTS

| | | | | |
|---|---|---|---|---|
| 1,671,650 A | | 5/1928 | Newman | |
| 3,687,329 A | * | 8/1972 | Baum | 220/216 |
| 3,993,214 A | | 11/1976 | Usab | |
| 4,556,368 A | | 12/1985 | Jean | |
| 4,987,949 A | | 1/1991 | Sakaguchi | |

(Continued)

FOREIGN PATENT DOCUMENTS

| | | |
|---|---|---|
| DE | 3927616 A1 | 12/1990 |
| EP | 1697234 B1 | 1/2012 |

(Continued)

OTHER PUBLICATIONS

Byrne, T. J., "The Use of Hollow Plastic Balls As Energy Conservation Devices in Heated Open Tanks," vol. II, Proceedings from the Fifth Industrial Energy Technology Conference, ALLPLAS Division, Capricorn Chemicals Corporation, Apr. 17-20, 1983, Secaucus, New Jersey, pp. 417-418.

(Continued)

*Primary Examiner* — Steven A. Reynolds
*Assistant Examiner* — Javier A Pagan
(74) *Attorney, Agent, or Firm* — Christensen O'Connor Johnson Kindness PLLC

(57) ABSTRACT

A production tank has at least one fluid outlet having a first flow area, an access port having a second flow area, and a fluid-containment space defined by a sidewall and a roof, the second flow area being larger than the first flow area. The fluid-containment space stories production liquids from a wellbore. A plurality of individual insulating elements are distributed across a horizontal section of the production tank, the insulating elements having a density that is less than the production fluids and having a size and shape that prevents passage through the first flow area and that permits passage through the second flow area.

6 Claims, 2 Drawing Sheets

(56) References Cited

U.S. PATENT DOCUMENTS

| | | | | |
|---|---|---|---|---|
| 5,564,588 | A * | 10/1996 | Reese | 220/565 |
| 5,940,578 | A | 8/1999 | Goddard | |
| 6,261,447 | B1 | 7/2001 | Van Herle | |
| 6,521,077 | B1 * | 2/2003 | McGivern et al. | 156/304.1 |
| 7,165,572 | B2 * | 1/2007 | Hebblethwaite | 137/312 |
| 7,387,473 | B2 | 6/2008 | Smith | |
| 2010/0257873 | A1 * | 10/2010 | Mueller et al. | 62/46.1 |

FOREIGN PATENT DOCUMENTS

| | | | |
|---|---|---|---|
| JP | 58-185782 | A1 | 10/1983 |
| JP | 62-008021 | A1 | 1/1987 |
| JP | 7-089592 | A1 | 4/1995 |

OTHER PUBLICATIONS

Float Actuation Type Tank Level Gauge, Installation & Operation Manual, Nivo Controls Pvt. Ltd., Indore, India, <http://www.graubardesign.com/projects/level_gauge/manual.pdf>[retrieved May 25, 2011], 13-page brochure.

LemTec Hexa-Cover Floating Disc System, Lemna Technologies Inc., Minneapolis, MN, advertisement published Nov. 26, 2012, 11 pages.

* cited by examiner

FLOATING INSULATION FOR A PRODUCTION TANK

FIELD

This relates to a layer of floating insulation in a production tank and a method of using the floating insulation in the production tank.

BACKGROUND

When used in colder climates, production tanks are generally heated and insulated in order to keep the fluids viscous and also to promote separation of the various components into layers, such as sand, liquid, and oil.

SUMMARY

There is provided a combination, comprising: a production tank comprising at least one fluid outlet having a first flow area, an access port having a second flow area, and a fluid-containment space defined by a sidewall and a roof, the second flow area being larger than the first flow area, the fluid-containment space storing production liquids from a wellbore; and a plurality of individual insulating elements distributed across a horizontal section of the production tank, the insulating elements having a density that is less than the production fluids and having a size and shape that prevents passage through the first flow area and that permits passage through the second flow area.

According to an aspect, the production liquids comprise a layer of sand, a layer of water, and a layer of oil, the oil having a density that is less than the water, and the insulating elements having a density that is less than the oil. Foam may carried by the production liquids, the insulating elements having a density that is greater than the foam.

According to an aspect, the production tank comprises a layer of fixed insulation on the roof and the sidewalls.

According to an aspect, there is a screen within the production tank that defines a lower limit to the position of insulating elements within the production tank.

According to another aspect, there is provided a method of insulating a production tank, the method comprising the steps of, in a production tank comprising at least one fluid outlet having a first flow area, an access port having a second flow area, and a fluid-containment space defined by a sidewall and a roof, the second flow area being larger than the first flow area, the fluid containment space storing production liquids from a wellbore: inserting a plurality of individual insulating elements into the production tank distributed across a horizontal section of the production tank, the insulating elements having a density that is less than the production fluids and having a size and shape that prevents passage through the first flow area and that permits passage through the second flow area.

According to an aspect, the production liquids comprise a layer of sand, a layer of water, and a layer of oil, the oil having a density that is less than the water, and the insulating elements having a density that is less than the oil. Foam may be carried by the production liquids, the insulating elements having a density that is greater than the foam. At least a portion of the foam may be broken as the foam comes into contact with the insulating elements.

According to an aspect, the production tank comprises a layer of fixed insulation on the roof and the sidewalls.

According to an aspect, the method further comprises the step of installing a screen within the production tank to define a lower limit to the position of insulating elements within the production tank.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
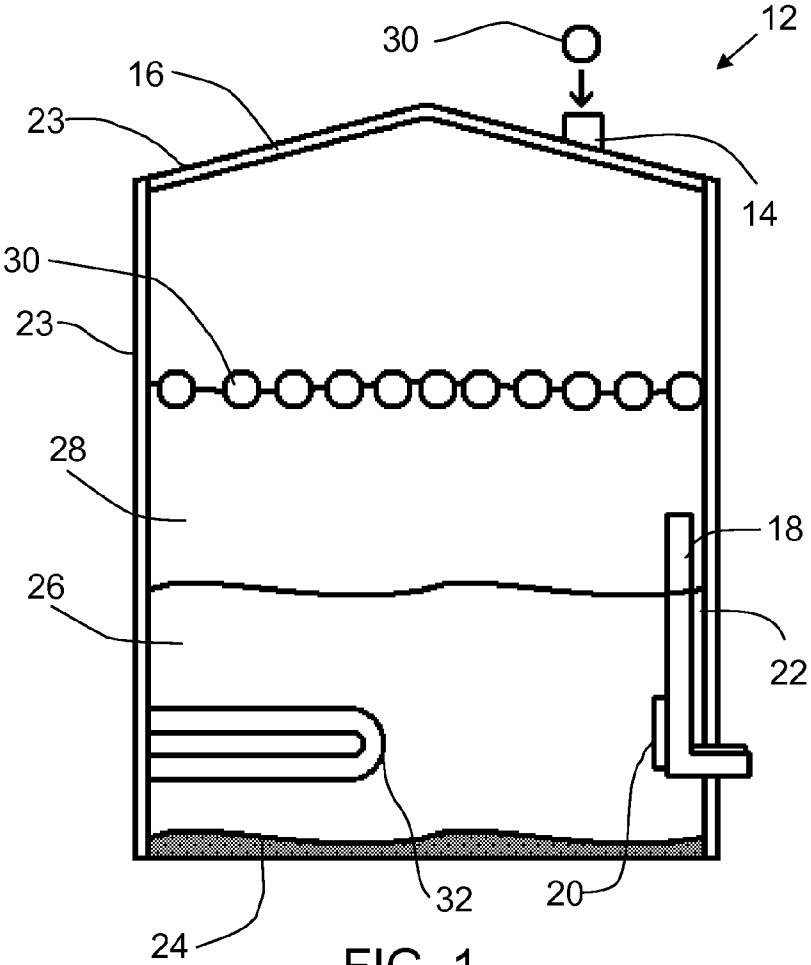
FIG. 1 is a side elevation view in section of a production tank with insulative elements being inserted.

Referring to FIG. 1, there is shown a simplified version of a production tank 12. For ease of reference, many elements that are not related to the discussion herein have not been depicted, such as the fluid inlet, various vents and nozzles, etc. that may be present either on a roof 16 of production tank 12 or elsewhere. As shown, production tank 12 has a port 14 on the roof 16 of tank 12 as well as a water outlet 18 and an oil outlet 20 in a sidewall 22 of tank 12. Port 14 is preferably a thief hatch as it generally provides a large, unobstructed access to the interior of production tank 12, but may be any suitable opening. Production tank includes a layer of fixed insulation 23 installed on an outer surface of production tank 12, both on sidewalls 22 and roof 16. Production tank 12 receives fluids produced from a well, which generally separate into a sand layer 24, a water layer 26 and an oil layer 28. Gas may also be released from the produced fluids, which may be managed in different ways, which are not relevant to the discussion herein.

Referring still to FIG. 1, a layer of floating, individual insulating elements 30 is inserted into production tank 12 through port 14. Preferably, port 14 is a thief hatch and will be referred to herein as such, as this generally provides adequate access to the interior of production tank 12. It will be understood that other access points may also be used or installed on tank 12, such as a manhole access (not shown) that may be located on tank 12. Insulating elements 30 is designed to float on oil layer 28 and may be made from various materials, such as closed cell foam, plastics, hollow structures, etc. Generally speaking, the structure is selected for having good insulative properties balanced with cost, availability and durability. As depicted, insulating elements 30 are spherical in shape, i.e. insulating balls, as these are generally easy to make and handle. However, other shapes may equally be used alone or in combination, such as a triangular prism, rectangular prism, ovoid, cylindrical prism or other shape including irregular shapes. The shape may be chosen to increase the surface area coverage of the insulation, such as by using octagons, etc. or to increase the surface area of the elements 30 to increase the foam breaking characteristics (described below), such as by providing protrusions.

Figure 2:
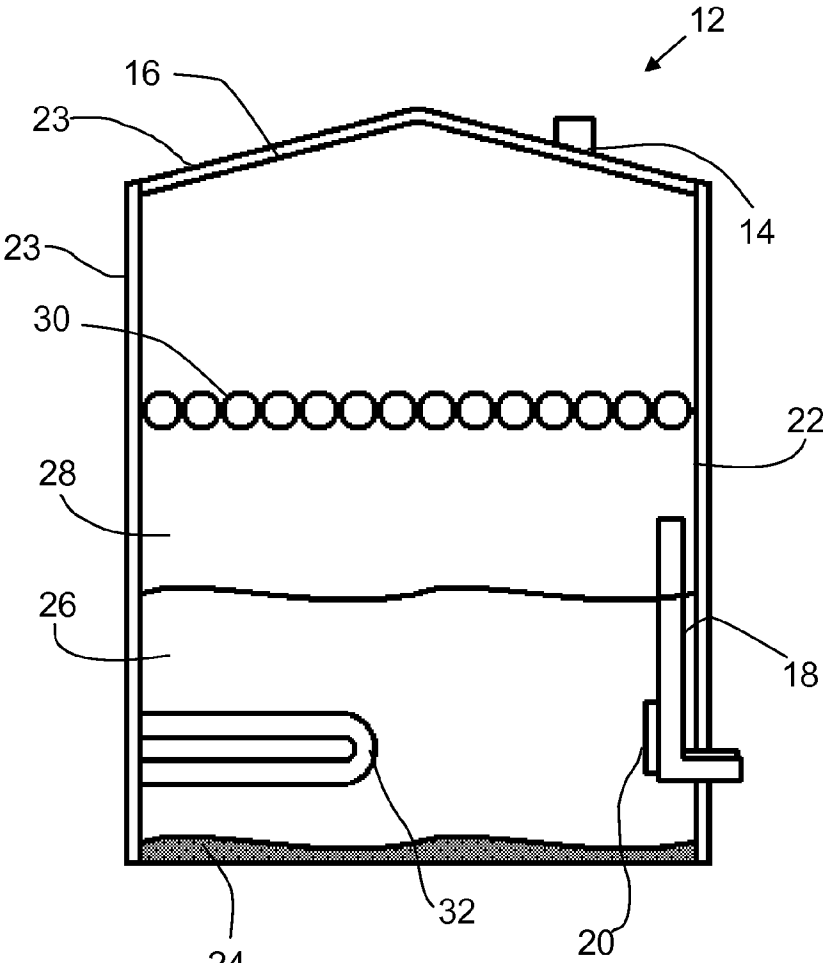
FIG. 2 is a side elevation view in section of a production tank with a layer of insulative elements.
Figure 4:
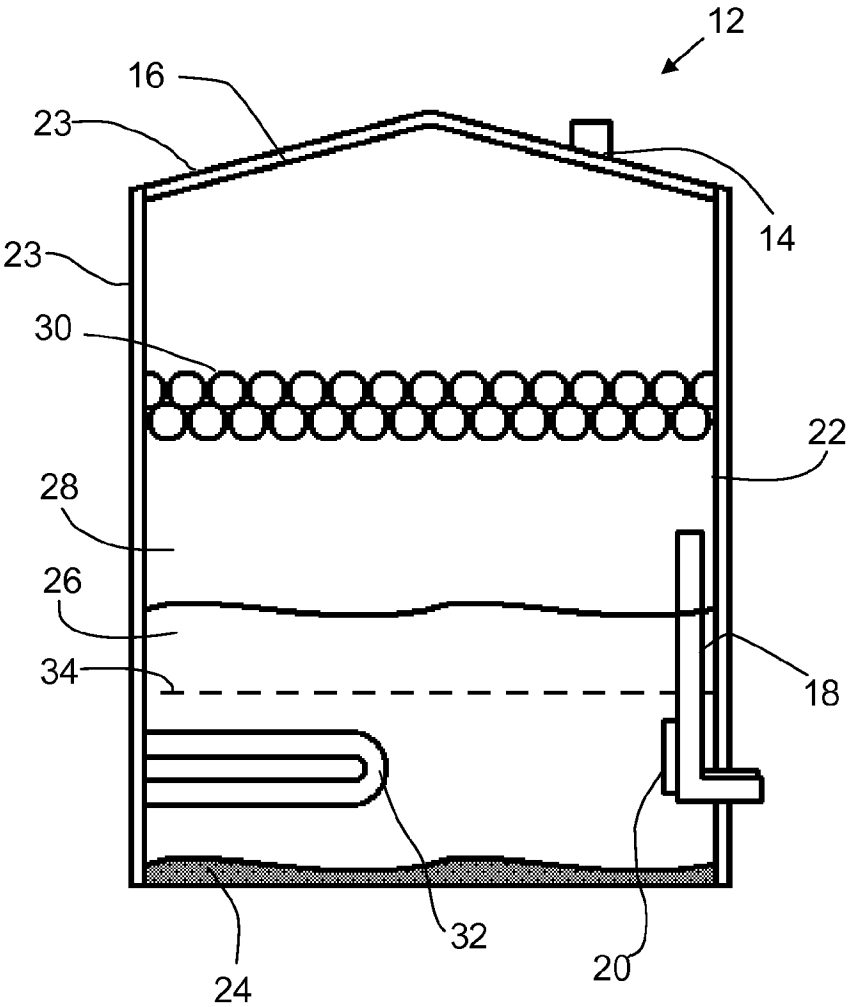
FIG. 4 is a side elevation view in section of a variation of a production tank with insulative elements.

Referring to FIG. 2, sufficient insulating elements 30 are inserted in order to cover oil layer 28 by at least a single layer within tank 12. This may be varied depending on the preferences of the user, and additional layers, such as two layers of insulating elements 30 as shown in FIG. 4, will increase the insulative and vapour capturing effects. As insulating elements 30 float on the top of oil layer 28, they help insulate the fluids from the airspace above oil layer 28, thus reducing the amount of heat loss from tank 12. While both the roof 14 and sidewalls 22 of tank 12 are insulated, it has been found that the airspace is still a source of heat loss, as air vents through ports 14, such as the vent and thief hatch of tank 12, i.e. the airspace is not a closed space. Insulating elements 30 also help reduce the vapours escaping from tank 12, which in turn reduces the build-up of ice on ports 14 of tank 12 and also reduces the release of noxious or malodorous vapours from being released from tank 12. Another benefit is the reduced heating requirement of water layer 26. Generally speaking, the heating element is positioned in water layer 26. As the heat transfer from water layer 26 to oil layer 28 is generally slow, there is a risk of overheating water layer 26 when there is a rapid heat loss out of oil layer 28, or oil layer 28 requires a significant amount of heating. By slowing the heat loss from oil layer 28, the risk of overheating water layer 26 is reduced.

Figure 3:
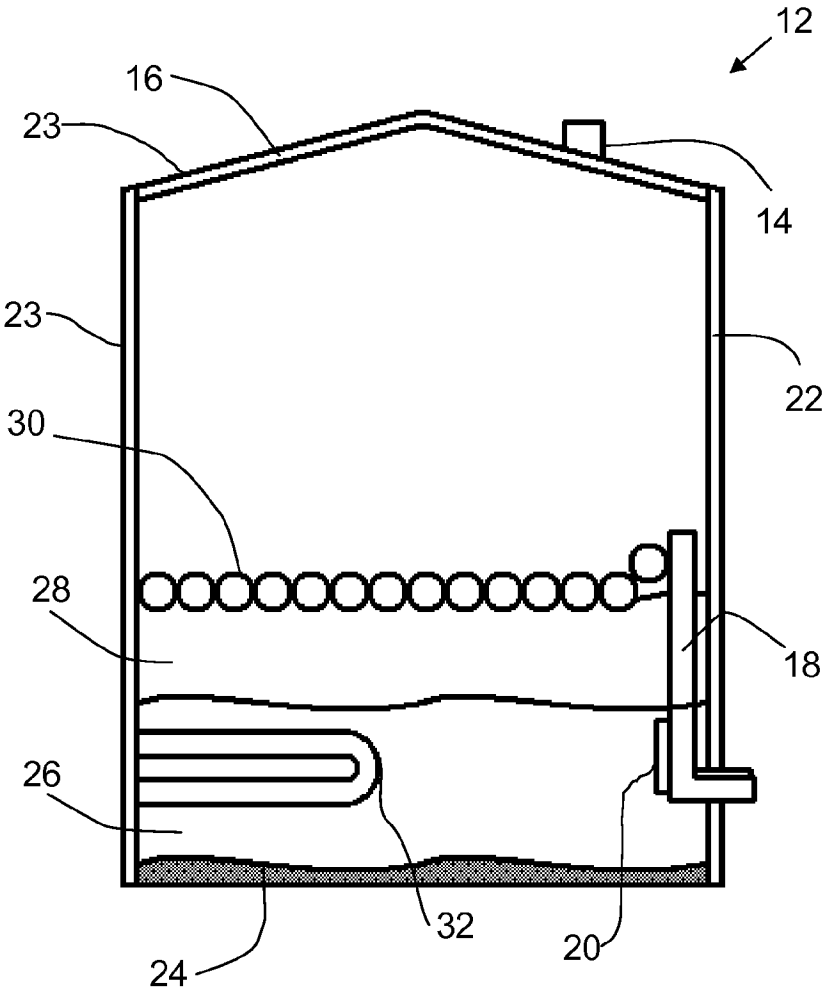
FIG. 3 is a side elevation view in section of a production tank with low fluid levels.

Referring to FIG. 1, insulating elements 30 are small enough that they may be inserted through thief hatch 14. Depending on the size of elements 30 and the size of thief hatch 14, multiple elements 30 may be inserted at the same time. Elements may be inserted manually, poured in from a container, blown in using a blower, or any other suitable technique. Referring to FIG. 3, insulating elements 30 are large enough that they will not pass through outlets 18 or 20. Instead, insulating elements 30 will be pushed out of the way as the liquid level decreases. Furthermore, as insulating elements 30 are individual and separate, they are also able to flow around any other obstacles in production tank 12, such as heating elements 32, sight glasses, etc. Referring now to FIG. 4, a screen 34 may be included that defines the lower limit of insulting elements 30 if contact with heating elements 32 may cause damage. A shown, the height of screen 34 is low enough to allow a wide range of fluid levels. Heating element 32 is generally designed to turn off if the fluid level drops significantly, such that this may be merely a precautionary measure. Alternatively, screen 34 may be positioned above outlets 18 and 20, which may be desirable if insulating elements 30 are smaller than the diameter of these outlets. Screen 34 may be made from any suitable material that can withstand the environment within production tank 12 with a mesh size that permits the free flow of production fluids, while preventing the passage of insulating elements 30. Screen 34 may be installed using different approaches, and may be mounted directly to the insides of production tank 12, or may be suspended from the top.

Insulating elements 30 may also be used to help break the foam that is sometimes present in the produced fluids. Foaming agents are sometimes used when treating a well or to help stimulate production. Foam may also result from the presence of gas in the produced fluids. Often, defoaming chemicals are injected in order to reduce the amount of foam. However, as the foam comes into contact with insulative elements 30, elements 30 help to break the foam, thus reducing the amount of defoaming chemicals required to be injected into the produced fluids. Depending on the circumstances, as gas rises up through oil layer 28 and comes into contact with insulative elements 30, insulative elements 30 may roll and in doing so, capture foam on an upper surface of elements 30, where it is more likely to break. In addition to reducing defoaming chemicals, it has also been found that, by increasing the stability of the temperature of oil layer 28, the amount of production chemicals used to lighten the oil may be reduced as well.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples above.

What is claimed is:

1. A method of insulating a production tank, the method comprising the steps of:

providing a production tank comprising:

at least one fluid outlet having a first flow area;

an access port having a second flow area, the second flow area being larger than the first flow area;

a fluid-containment space defined by a sidewall and a roof, the fluid-containment space storing production fluid from a wellbore;

a layer of fixed insulation on the roof and the sidewall; and a heating element disposed within the fluid-containment space to heat the production fluid;

inserting a plurality of individual insulating elements into the production tank distributed across a horizontal section of the production tank, the insulating elements having a density that is less than the production fluid and having a size and shape that prevents passage through the first flow area and that permits passage through the second flow area; and pumping production fluids into the production tank from the wellbore, the production fluid comprising natural gas, oil, water, and sand.

2. The method of claim 1, wherein the production fluid in the fluid containment space settle into a layer of sand, a layer of water, and a layer of oil, the oil having a density that is less than the water, and the insulating elements having a density that is less than the oil.

3. The method of claim 2, further comprising foam carried by the production fluid, the insulating elements having a density that is greater than the foam.

4. The method of claim 3, further comprising the step of breaking at least a portion of the foam as the foam comes into contact with the insulating elements.

5. The method of claim 1, further comprising the step of installing a screen within the production tank to define a lower limit to the position of insulating elements within the production tank.

6. The method of claim 1, further comprising the step of heating the production fluid using the heating element.

* * * * *